US011253031B2

(12) United States Patent
Baptista De Souza

(10) Patent No.: US 11,253,031 B2
(45) Date of Patent: Feb. 22, 2022

(54) "X" STITCHING METHOD FOR MOUNTING UPPERS BY MEANS OF THE STRING-LASTING SYSTEM

(71) Applicant: INDUSTRY AND TECHNOLOGY LTDA, Nova Hamburgo (BR)

(72) Inventor: Silvano Baptista De Souza, Novo Hamburgo (BR)

(73) Assignee: INDUSTRY AND TECHNOLOGY LTDA, Novo Hamburgo (BR)

( * ) Notice: Subject to any disclaimer, the term of this patent is extended or adjusted under 35 U.S.C. 154(b) by 109 days.

(21) Appl. No.: 16/477,069

(22) PCT Filed: Mar. 15, 2017

(86) PCT No.: PCT/BR2017/050057
§ 371 (c)(1),
(2) Date: Jul. 10, 2019

(87) PCT Pub. No.: WO2018/129601
PCT Pub. Date: Jul. 19, 2018

(65) Prior Publication Data

US 2019/0328086 A1 Oct. 31, 2019

(30) Foreign Application Priority Data

Jan. 11, 2017 (BR) ..... 10 2017 0006115

(51) Int. Cl.
*A43D 21/00* (2006.01)
*A43D 9/00* (2006.01)
*A43D 119/00* (2006.01)

(52) U.S. Cl.
CPC ..... *A43D 21/003* (2013.01); *A43D 9/00* (2013.01); *A43D 119/00* (2013.01)

(58) Field of Classification Search
CPC ..... A43D 21/00; A43D 21/003; A43D 9/00; A43D 119/00
See application file for complete search history.

(56) References Cited

U.S. PATENT DOCUMENTS 1,469,222 A * 10/1923 La Chapelle ..... A43D 9/00 12/145
1,833,229 A 11/1931 Sahr
3,474,475 A 10/1969 Fisk
3,972,086 A * 8/1976 Belli ..... A43D 21/003 12/7.9
2018/0140055 A1* 5/2018 De Souza ..... A43D 21/003

FOREIGN PATENT DOCUMENTS

BR 8300314 U 11/2004

* cited by examiner

*Primary Examiner* — Ted Kavanaugh
(74) *Attorney, Agent, or Firm* — McKee, Voorhees & Sease, PLC

(57) ABSTRACT

This is a patent application for an X stitching method, specifically intended for the assembly of uppers by the system known as tied string—stringlaster, with particular application in the footwear segment. The invention includes application to an upper (1), for full assembly of shoes, using string traction (2) as the responsible element for closing the edges of this upper (1), against the mold (3); with the overlock type stitching hereby used as an example of realization.

4 Claims, 8 Drawing Sheets

"X" STITCHING METHOD FOR MOUNTING UPPERS BY MEANS OF THE STRING-LASTING SYSTEM

FIELD OF THE INVENTION

This is a patent application for a cross-stitching method, using stitching machines or manual sewing, applied to an upper, for the assembly of shoes, to generate a cross vector traction, resulting in integral, proportional, symmetric and simultaneous fitting, of the upper, to the body and the sole of the mold, in the region of the insole, completely covering the three different areas of assembly of shoes, i.e. the toe, the middle of the shank region and the rear; it particularly concerns a "X" stitching method, intended for the mounting of uppers using the so-called stringlaster system, with particular application in the footwear segment.

BACKGROUND OF THE INVENTION

Following the development of the equipment that is the object of patent application BR102015013357-0, entitled MACHINE FOR MOUNTING UPPERS WITH STRING TRACTIONER, whose International Search Report indicated the non-existence of priority documents, the inventor has been working on the applicability of the mounting method.

Initially, the string stitching method, commonly used for the manual assembly of uppers, adopted a fabric latch in the region of the shank, or central region of the sole of the shoe, with the aim of fitting and sealing the upper to the mold, in this region. The string traction acted on the whole region of the toe and the rear, in order to complete the assembly. This same method of stitching, using a fabric latch (or another of similar material), on being tractioned by the machine described above, proved to be extremely efficient, increasing the productivity and the quality of the process, now performed by machinery, due to the various resources available in the equipment, regarding control and ergonomics.

However, fabric latches were created to enable the manual operation of the assembly, due to the limited demand for power when tractioning the strings.

This kind of assembly by tractioning of the string was used in the manufacture of light shoe models, with straight soles, with simplified structures and of low added value.

However, the use of the fabric latches presented limitations, both of quality and productivity, and was not in accordance with optimized industrial processes, which seek greater efficiency per capita.

The dependence on human ability in repetitive operations, such as in the stitching of these fabric latches, to attach them to the uppers, produces an irregularity, which is reflected in the quality and comfort of the shoe. This factor added to the consumption of the material of the latch itself, the low quality of the final product, following the assembly and the desire to extend the string technique, to other models of existing footwear, with high standards of quality and comfort, prompted the company to develop an alternative solution, based on a new stitching methodology, compatible with the technology of the assembly machine, created by the company and mentioned above.

Thus the "X" stitching strategy was born, capable of enabling, with maximum efficiency, through the method of string traction, the assembly of any model of shoe known. Initially, this stitching strategy needed to be improved, in terms of execution and position. At this time, an "X" was used for flat shoe and another "X", as needed, for shoes with a higher number of negative angles, which is to say, shoes with heels and boots.

During the tests, it was perceived that, by altering the traction angle of the string and the position of the "X", it was possible to determine which part of the shoe is subjected to the traction power of the string. Adding to these factors the resistance of the edges of the mold, it became possible to achieve, in a single string-traction procedure, the perfect and simultaneous fitting of the upper to the mold, copying (the lines) to the anatomy of the mold, without creating lines of tension.

Thus, it was observed that for each model of footwear, for each negative angle, there is a more appropriate "X" angle, as well as a more suitable traction angle, which is to say, in most cases, only a cross-stitch is sufficient for the correct fitting of the upper to the mold.

So, following these analyses, added to the equipment already developed and with the patent requested, resources and tools were developed and, added to this, equipment capable of allowing the traction of the string with the adjustment of the angles.

Thus, the method hereby proposed arises associated with a new shoe-assembly technology, which includes a machine for the shoe-assembly by string-traction, with tools, a modeling technique and a stitching strategy, capable of assembling shoes, in a single procedure, with greater productivity, quality and comfort, and at a reduced cost.

STATE OF THE ART

The state of the art comprises several ways to assemble shoe-uppers by way of:

Manual assembly: this is assembly performed by hand. In this process pliers are used to help the mounter fold the upper under the mold, in the area of the sole of the foot. Subsequently a hammer is used to fix the upper to the insole, using small nails or through adhesive previously applied to the upper and insole;

Assembly with a toe-assembly or pointing machine: another way of assembling shoes is by using a toe-assembly machine which, in turn, mounts only the toe of the shoe, with or without the application of thermal adhesive. Equipped with several gripping clamps, which hold the edges of the toe of the uppers and bend them under the sole of the mold. Subsequently tools, called scissors, complete the fitting of the upper to the mold. The evolution of this assembly occurs by means of equipment capable of assembling the toe and middle of the shoe, in the region of the shank, simultaneously;

Assembly with rear or shoe-assembly machine: there are also machines intended for assembling only the rear of the shoe, with or without the application of thermal adhesive. This process is very similar to the one described above. The equipment designed for this assembly is equipped with several gripping clamps, which hold the edges of the rear of the upper and fold it under the sole of the mold. Subsequently, tools, called scissors, complete the fitting of the upper to the mold. The evolution of this assembly occurs by means of equipment capable of assembling the rear and the middle of the shoe, in the region of the shank, simultaneously;

Bagged assembly: bagged assembly is thus known, because the upper is stitched to a thin fabric insole, which seeks to determine the lines and curves of the lower ends of the sole of the foot. This stitching is also done by an overlock machine however, it does not incorporate a wire for traction. After stitching, the shoe acquires the mold of the foot and can be integrated into the upper, by adhesive or direct injection of the sole;

Assembly by the string-system, the assembly of the shoes by stringlaster or string traction, is already widely known but used traditionally only for shoes with uppers of light materials, closed shoes or shoes without heels (flats), for example, tennis shoes and sneakers whose assembly is either by string traction and performed with the aid of simple devices, or manually, by people of substantial physical size. In these cases, the overlock stitching strategy on the string traction only follows the external profile, which is to say, without X stitching, as shown in FIG. 5, where the start of the stitching is A and the end is B, not offering great resistance at the time of tractioning. For the string method, without X stitching, it is necessary to use a traction latch in the region of the shank, which can be of sewn fabric, as shown in FIG. 5, position T, or metal barbs fixed to the mold, where the upper and the string are coupled, as in position K in FIG. 8. In addition to this, the string method, without X stitching, requires a knot, so that the shoe does not disassemble when the tips of the string are released. In some cases, the shoes can be assembled, using the string method without X stitching, in a mixed manner (semi-bagged), which is to say, the upper will be closed only at the toe, or only at the rear, or in the area of the toe and in the area of the rear, by the string traction and in the middle of the foot, in a wider area than the area occupied only by the latch, and a thin fabric insole stitched, in an attempt to copy, in a rudimentary manner, the lines of the mold.

In other words, only these methods or processes are used, everywhere in the world, where the manufacture of shoes is undertaken using the stringlaster method.

So, any industrial process that involves major dependence on the operator is subject to variations in quality, precision and productive capacity. The ideal situation, corresponding to the current demands of the industry, is an assertiveness guaranteed by the equipment, where the man exercises his knowledge, by determining and conferring the action of this machinery, without having to make unnecessary physical effort, execute decisive procedures, or perform functions that lead to illness and injury caused by repetitive exertion.

Manual assembly is restricted to the limitations of this process, both in the production capacity and in the regularity of the results and even in the quality of the product. These limitations also occur, albeit at a lower percentage, in the assembly by part-assembly machines of the shoe, separately (toe, shank and rear). Even bagged assembly is restricted to some models of shoes, because it does not guarantee the quality and repetition of the results, necessary to all models. This overlock stitching, which attaches the upper to the insole, and the mold to the shoe is highly variable, since its precision depends on the dexterity of the seamstress and this can compromise the fidelity of the lines and curves of the mold. This way of assembling shoes, is generally suitable for assembly with soles that have sides capable of surrounding the side of the upper, called box soles, to conceal the irregularities arising from this process.

In all these processes, even when performed based on norms and respecting the anatomy of the human foot, as designed by the modeler, the final product can be quite different from that initially intended.

In addition to these negative aspects, which encompass the processes described above, we emphasize, in comparison with the process of assembly by the string traction system using the "X" stitching strategy, the high production costs, taking into account the excessive raw material, necessary for the manipulation of the edges of the upper, or the stitched insole, besides more robust components, which guarantee the appropriate structure to the shoe, the production of residues resulting from this excess of material. The operating costs, such as a greater number of machines necessary to complete the assembly, or the precision of high-value-added machinery (for example, toe-assembly machines), in addition to using specialist labor, though obsolete and in the process of dying out, and the high consumption of electricity, are equally responsible for the higher production cost.

Assembly by string traction, with a strategy of only stitching the outer edge of the upper, without the X stitching, causes a separation and an undesirable gap between the upper and the mold, FIG. 6, position T and FIG. 7, position T, when the profile of the mold is a negative curve, FIG. 6, position N and FIG. 7, position N, at the time of assembly, which is to say, in the string traction. The curve of the mold is negative in two situations: on the reference plane Z or vertical plane (FIG. 6), and on the references plane X or Y (FIG. 7). The string tractions the upper and applies pressure to the mold only when the curves are positive.

Uppers can be assembled in full, by means of the string traction system, without X stitching and without latches in the shank, but this disfunction of the method is inefficient, since, in this case it is impossible to copy the lines of the mold, which reflect the lines of the human foot. An upper assembled in this way, without adjustment, including to the shank, does not respect the anatomical needs of the foot. Although the string traction meets little resistance in this assembly allowing, on the one hand, the manual assembly of the shoe, or the assembly with the help of simplified devices, on the other hand, it restricts the string technique to shoes of very low quality, excluding a multitude of models.

Thus, prior to the development of this method by the inventor, which is to say, the "X" stitching strategy, to allow the adjustment and sealing of the upper to the mold, in the region of the shank, there were only three known ways:

Fabric latch: In this case a fabric latch is stitched to the upper, in the region of the shank, which copies the lower lines of the middle of the mold, as shown in FIG. 5, position T; this technique has the following problems:

Impossibility of repeating the spacing between the edges of the stitched upper, due to the manual preparation process and stitching of the latch, and the attachment of the upper;

Imperfection in the repetition of the longitudinal positioning of the latch, when stitched to the upper, thus prejudicing the fair and correct attachment of the upper to the mold;

The type of stitching used for this operation of the seam of the latch with the upper causes an increase in the thickness of the whole, which consequently transmits imperfection to the sole;

Because it is physical, it is one more item to be produced, increasing the operational costs, including those of purchase, storage, the cutting process, waste and labor;

Barbs or pointed metal latches fixed to the mold: In this case, barbs or pointed latches are fixed to the mold in the position of the shank, as shown in FIG. 8, position K, which will serve as support for the upper, at the time of the string traction; this method presents the following problems:

This artifice introduces the danger of workplace accidents to the assembler, evidenced by the pointed tips of the barbs;

It is an operation that adds extra time to the process. This rudimentary technique is usually limited to assemblies of uppers that will be aggregated by directly injected soles and to uppers made of flexible materials;

Insole for semi-bagged or mixed assembly: In this case a fine insole is stitched to the upper, similar to that used in bagged assemblies, but, unlike the bagged assembly, in the semi-bagged assembly, the insole is not fully attached to the upper, leaving out the toe, or the rear, or the toe and rear, of the upper. These areas will be assembled subsequently, by the traction of a string, which will be responsible for the partial closure of the rest of the upper. This method is used for the placement of tips, on safety shoes, for example; this method presents the following problems:

The problems, in this case, resemble those found in the cases that use the latch, for adjusting the shank:

the positioning of the insole and the distance of the seam, in relation to the edges of the upper, are variable, because they depend on the dexterity of the seamstress;

The adjustment of the shank is imprecise, because the imprecise seam does not provide an assembly that preserves the lines of the mold, hindering the attachment of the upper to the mold, which is reflected in the quality and comfort of the shoe;

The insole and seam form an undesired volume, which can interfere with the comfort of the shoe;

the operational cost is high since the seam of this insole requires more material, raw material, machinery and time, for the manufacture of the shoe, which are not necessary in the case of assembly by string, with X stitching.

Normally, in the cases of shoes assembled using the stringlaster method, which is to say, of string traction, without the X stitching, the tips of the string need to be tied, immediately after the string traction, so that the assembly is maintained.

Due to these process limitations, the string system remained unchanged and restricted only to the production of light shoes, which is to say, made from flexible materials and poorly structured components, resulting in a shoe of lower added value, which does not require great precision in its assembly, such as, for example, some types of sneakers, children's shoes, tennis shoes and safety shoes.

THE INVENTION

The invention comprises a methodology with X stitching, using an overlock machine or one with a similar function, applied to an upper, for assembling shoes, in order to provide cross vector tractioning, resulting in full, proportional, symmetric and simultaneous fitting of the upper, to the body and the sole of the mold, in the region of the insole, fully encompassing the three different areas of the assembly of shoes, such as the toe, the area in the region of the shank and the rear. So, the order of the stitching of the "X" methodology hereby described can be reversed, or mirrored, or initiated or terminated, at other points of the circuit, depending on the stitching equipment available, or the operator's preference. More specifically, it describes a method of a strategy and operational sequence of stitching of the overlock type or others, with crossing, known as the "X" system, which stitching is applied to the edge of the upper, overlapping and surrounding the traction string, intended for the stringlaster assembly of shoe uppers, on molds or matrices, as shown in FIG. 2, where A and B are the ends of the string and C is the crossing of the string, when the "X" stitching strategy is used.

The method of this invention has the aim, through this methodology or stitching strategy, of developing the system known as string (stringlaster), which was restricted to the assembly of light shoes, and to revolutionize the current form of assembly, of any models of industrialized shoes, in the world. This methodology was developed to complement and encompass the use of the machine already mentioned in this patent application, for full assembly of shoe uppers, of all known types and designs (models), made from synthetic materials or leather, of various levels of thickness, structured by internal components, or not, such as: men's, women's and children's shoes, for various fields of application, such as sports, casual, social, orthopedics, safety shoes, of different models, such as boots, booties, closed toe shoes, sneakers, peep toes, sandals, tennis shoes, moccasins, etc.

The "X" stitching strategy was developed to resolve technical and economic limitations, concerning the assembly of shoes using the string traction system, allowing for the assembly of shoes in a single operation, with gains in quality and comfort, and remaining faithful to the aesthetic concepts of the model, through new concepts of technical modeling of shoes, associated with the equipment previously cited, developed, conceived and improved, for this process, by the applicant. It has a principal objective of reducing various operating costs, including savings regarding electricity, raw materials, industrial waste, rationalization of labor and complementary operations; moreover, the method is responsible for improving the quality of work of the operators and brings speed to the production of shoes, becoming fundamental to the increase in "percapta" productivity of assembly lines.

This technology, with added resources, consisting of the "X" stitching strategy, more machinery and new modelling patterns, brings to national industry a high level of efficiency and a great cost/benefit ratio, being in accordance with social and sustainable policies, and with the regulatory norm of safety in the workplace NR12. Moreover, the integrated technology developed by the applicant, due to its low cost and great flexibility, is suited to the productive demands of small, medium or large companies, strengthening the shoe sector and enabling companies to face up to international competition, particularly unfair competition, practiced by some companies that do not possess social policies, or policies concerning sustainability or the safety of workers, adapted to international requirements.

The methodology of the "X" string stitching system fulfills, by itself, all the needs of traction vectorization, applied to the "X" upper as shown in FIG. 4, at the time of the assembly of this upper on the mold or "Z" matrix of FIG. 4, in accordance with the "V" vectors indicated in FIG. 3, when the ends of the string A and B are tractioned in the direction also indicated in FIG. 3. The correct positioning and sequence of application of the stitching wholly fulfill the sealing of the upper to the body and sole of the mold, in the region of the insole, completely covering the three different areas of the assembly of shoes, such as the toe, the area in the region of the shank and the rear, in the act of assembly, as shown in FIG. 3.

So, the "X" methodology of overlock stitching is applied to an upper, for integral assembly of shoes, using string traction as an element responsible for closing the edges of this upper, against a mold, whose format reproduces the anatomy of the human foot.

The assembly of string traction (string or stringlaster method) occurs by applying a traction force to a string, stitched in the lower edges of an upper, which will be compressed, by traction, against a mold, until these edges close. The direction of the movement of the edges, exerted by the traction of the string is downwards and towards the center of the mold. This traction is intended to fully seal the upper and eliminate any spaces or wrinkles that might affect the perfect sealing of the upper, originally on a 2D plane, as it is produced on and around a three-dimensional 3D mold, which translates the anatomical mold of the human foot.

This "X" methodology of stitching and assembling shoes can be applied to all models of shoes and all known heights of heels, such as shoes without heels or flat type sneakers, tennis and children's shoes, sandals, men's shoes, safety and occupational shoes, and even pumps and high-heeled women's boots. Following this assembly, the sole can be glued or directly injected.

Technically, the "X" stitching methodology and strategy is the link that was missing for the evolution of the process of assembling shoes using the string method, considering that, when associated with other developments of the process such as directed modeling, string traction machinery (stringlaster), with proportional control and with directed tools (String Guide Module, for example), in accordance with the development and patent of the applicant, with its techniques of application, provide the market with a new and efficient assembly technology capable of covering all known models of shoes, with gains in quality, comfort, production cost, reduction of raw material consumption and a consequent reduction in the production of waste, energy savings and improvements in the quality of operators' work.

The applicant has developed and requested the patent of a device for assembling uppers by string traction, with intelligent control of speed and power, rear support for the mold, string guide roll, verticals and horizontal adjustments, and transparent protection, among other resources, capable of assembling, in a single procedure, all known models of shoes, no longer restricting the string method to the assembly of light shoes. After the creation of the machine, initially, the applicant developed a modeling methodology for the adaptation of models assembled by the traditional methods, to the string method. This methodology had already created advances when compared to the traditional modelling methods, because it enabled a more economical and assertive constructive mold, bringing greater quality and comfort to the shoe, reducing assembly margins, replacing more rigid components, with more flexible and cheaper components, consequently reducing the production of waste. Furthermore, the assembly system proposed by the applicant also reduced the need for multiple reheating of the upper, for gluing and shaping, which led to a reduction in the consumption of electrical energy.

As the technology evolved, through application testing, developed and administered by the applicant, by studying each model of shoe and the most efficient way to adapt them to the string method, extracting from this technique the greatest number of benefits, the "X" stitching strategy emerged. It was initially developed to improve the fitting of the upper to the tips with negative angles, both in relation to the shank, and the height of the heel, and to replace the need for other latches (fabric or nails), reducing the operating costs and consumption of raw material. So, the applicant created and tested stitching with more than one cross, depending on the needs of the angles of the shoe. However, the definitive solution arrived with the use of tools, also developed by the applicant, to adjust the height and position of the string traction (String Guide Module). This factor allowed for the full adjustment of the upper to the mold, with maximum efficiency, without the use of fabric latches or nails, and with a single X stitch.

DESCRIPTION OF THE DRAWINGS

The invention will duly be described in one form of embodiment, and, for better understanding, references will be made to the attached drawings, in which the following are represented.

DETAILED DESCRIPTION OF THE INVENTION

Figure 1:
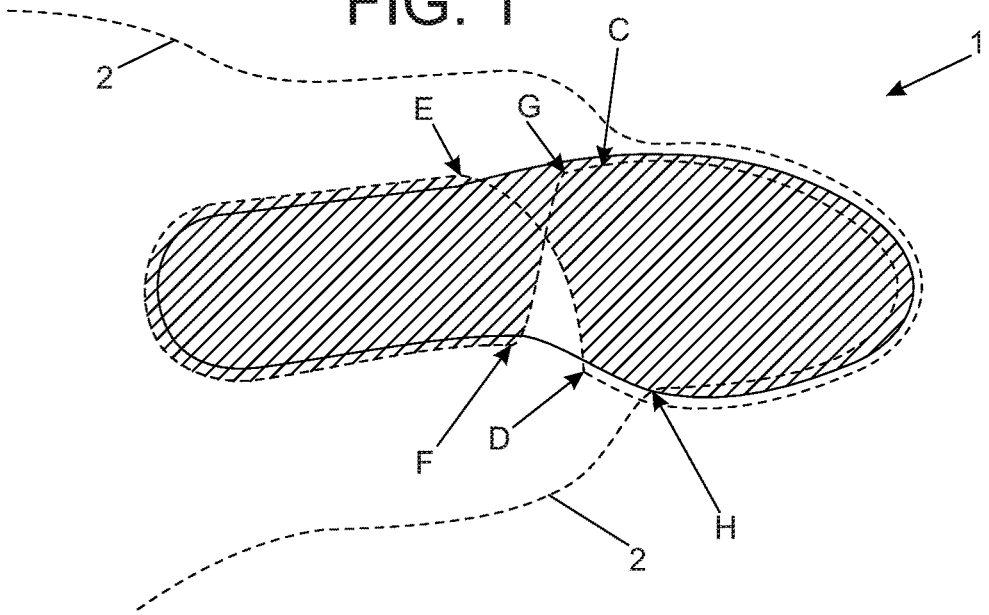
FIG. 1: shows the overlock type stitch, used here as an example, applied in an "X" to the upper.

"X" STITCHING METHOD FOR THE MOUNTING OF UPPERS BY THE STRING-LASTING SYSTEM, the object of this patent application, comprises a methodology with "X" stitching, using an overlock machine or one with a similar function, applied to an upper (1), for the assembly of shoes, in order to provide cross vector traction, resulting in the full, proportional, symmetric and simultaneous fitting of the upper (1), to the body and sole of the mold (3), in the region of the insole, completely covering the three different areas of assembly of shoes, such as the toe, the area in the region of the shank and the rear.

So, the order of the "X" stitching methodology, described herein, can be reversed, or mirrored, or initiated or terminated, at other points of the circuit, depending on the stitching equipment available, or the operator's preference. An alternative example to the overlock stitching, for example, can be the application of the "X" stitching methodology using a programmable automatic sewing machine, CNC, with a Cartesian coordinate table, with or without the third or fourth axle integrated, with a view to increasing the speed of the process, but without discarding other sewing machines, such as zigzag, or even manual sewing.

For the purpose of illustrating the invention, the example of realization hereby used will be the overlock stitching type applied to an upper (1), for the full assembly of shoes, using string traction (2) as the element responsible for closing the edges of this upper (1), against a mold (3), whose shape reproduces the anatomy of the human foot. It is important to clarify that the position in which the upper (1) is found in the mold, at the time of the stitching—front or back—, does not modify the result of the stitching.

The assembly of shoes by string traction (string or stringlaster method) occurs by exerting a traction force on a string (2), sewn on the lower edges of an upper (1), which is compressed, by the traction, against a mold (3), until these edges close. The direction of the movement of the edges, exerted by the string traction (2) is downward and towards the center of the mold.

This tractioning is intended to fully seal the upper (1) and remove any gaps or wrinkles that may prejudice the perfect sealing of the upper, originally on a 2D plane, as it is produced, on and around a three-dimensional mold (3D) (3), which translates the anatomical mold of the human foot.

This "X" stitching and assembly methodology of shoes applies to all models of shoes and all known heights of heels, such as shoes without heels or flat type sneakers, tennis and children's shoes, sandals, men's shoes, safety and occupational shoes, and even pumps and high-heeled women's boots. After this assembly, the sole can be glued or directly injected.

The sequence of the methodology and strategy of the directional sequence of the overlock stitching (hereby used as an example of realization) on the edge of the upper (1), involving the string traction (2), comprises the following steps, with the direction of the stitching being from right to left or left to right:

The first procedure is to determine the reference points for the start (C) as shown in FIG. 1, and the end of the stitching (H), in the same FIG. 1. The ends of the string (2) need to be long, to facilitate their fixing to the traction element (tractioner).

Figure 2:
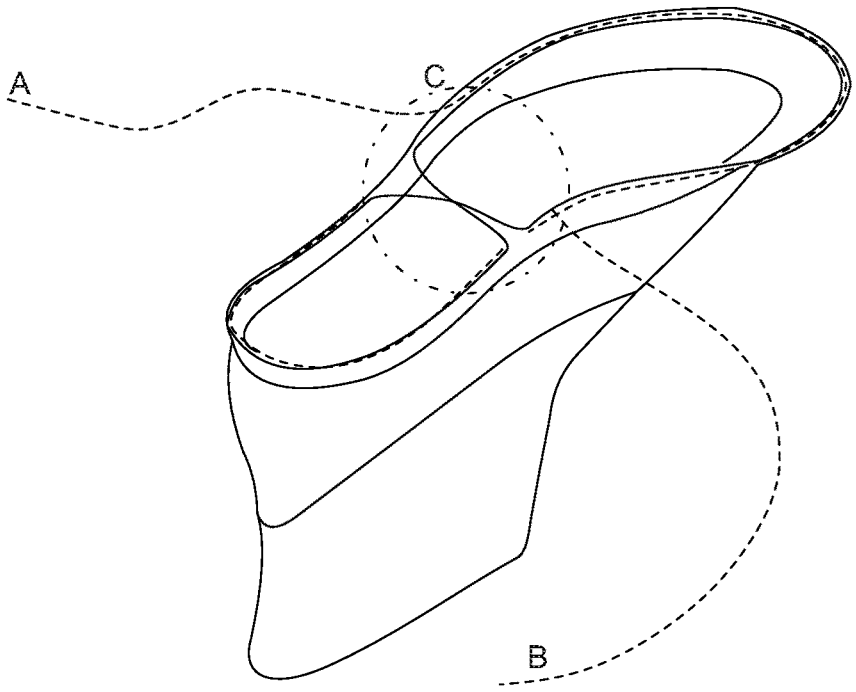
FIG. 2: shows the upper with the insole and the "X" stitch next to the mold.

It should be clarified that the positions, of the start of the stitching and the location of the "X", should be determined at the time of the stitching, only in the execution of the models, because on the production line, these positions already come previously marked, usually by small cuts, for the guidance of the seamstress;

The second procedure is the demarcation on the upper (1), of the position of the X stitching, which is to say, at this time the right point will be determined where the traction string (2) must pass, from one side to another and vice versa. This point is called the "X" (X) position and is visible in the references (D); (E); (F); and (G), as shown in FIG. 1 and also in the reference (C) of FIG. 2 (region of the shank). This position of the "X" determines the inversion of the side of the overlock stitching in the upper (1), in the region known as the "shank" (C) in FIG. 2. From this point, the upper (1) is tractioned, in the vector direction (V), in accordance with FIG. 1, resulting in the integral fitting of this upper against the surface of the mold, producing maximum efficiency. The traction angle is variable, according to the model of shoe to be assembled (with heels, fiats, women's, men's or children's shoes, etc.). The necessary variation of the traction angle is defined by the different angles, vertical and horizontal, which the model possesses (height of heel, width of shank, etc.). The traction angle, during the traction, provides greater or lesser resistance, at points of the mold; thus the traction is exerted with equal force, but the closure of the upper (1) occurs at slightly different times, for each region of the shoe, previously determined.

Figure 3:
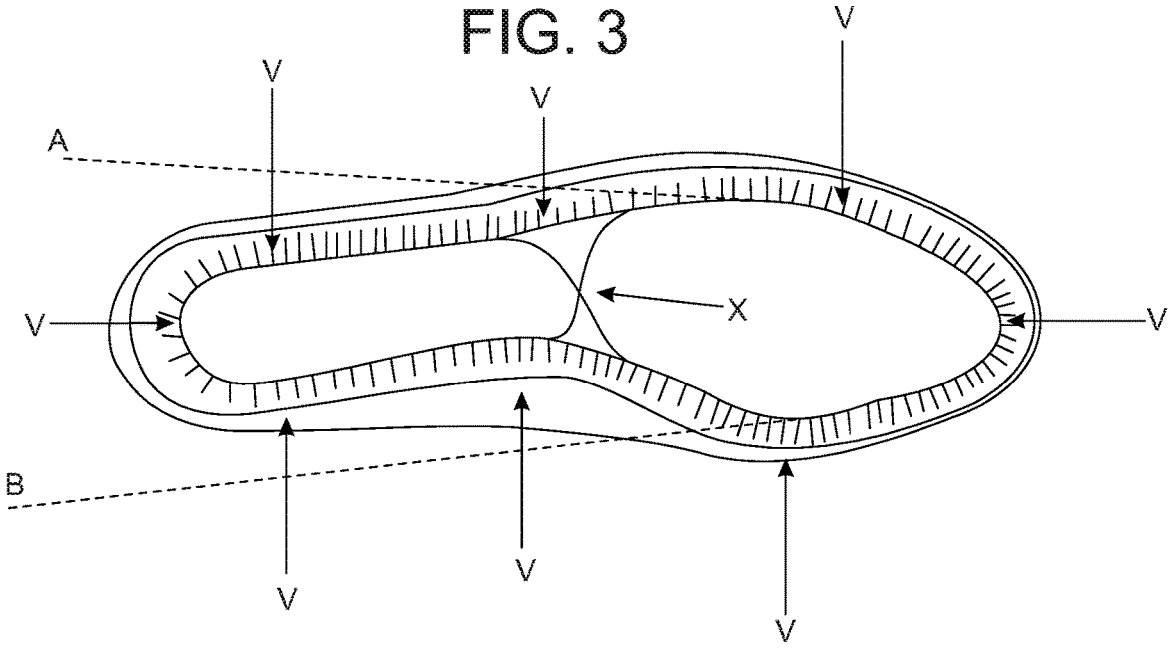
FIG. 3: Top view of the upper with the insole and the "X" stitch, showing the "V" vectorization.
Figure 4:
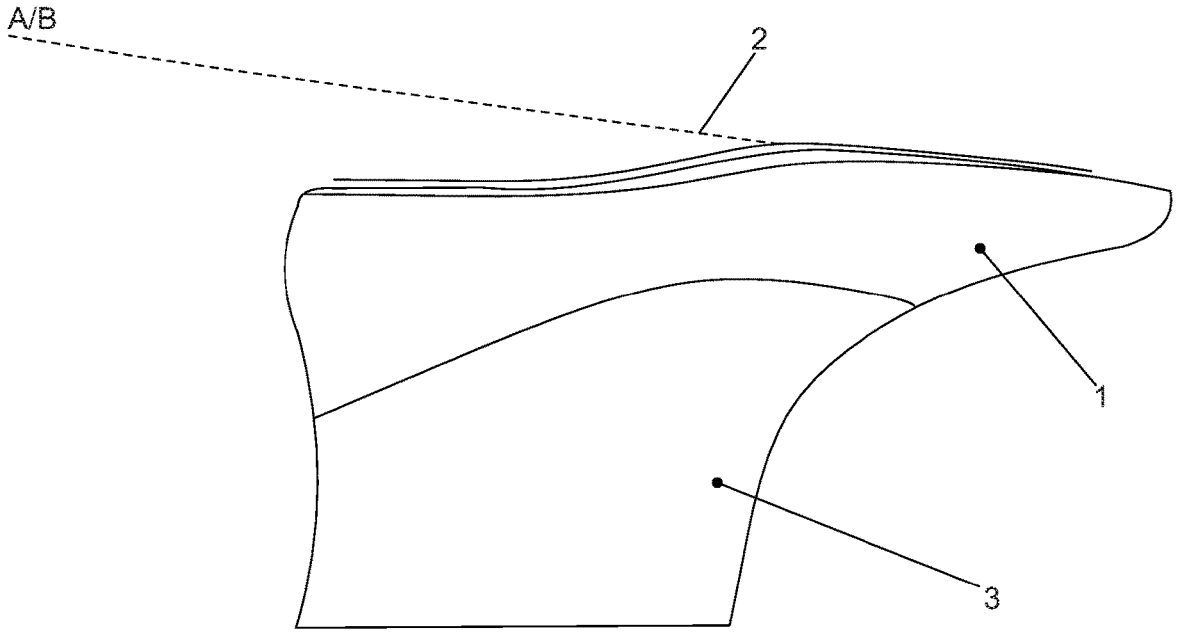
FIG. 4: Side view of the upper with the insole applied to the mold with the string.
Figure 5:
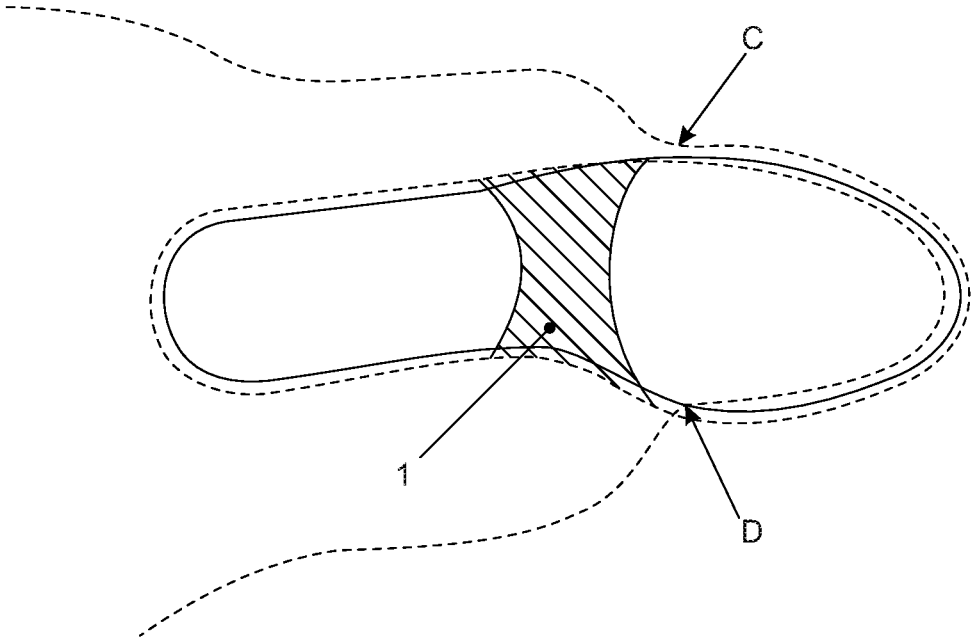
FIG. 5: Shows the overlock stitching, used here by way of example, without "X" stitching, in a pattern that does not offer great resistance to traction.
Figure 6:
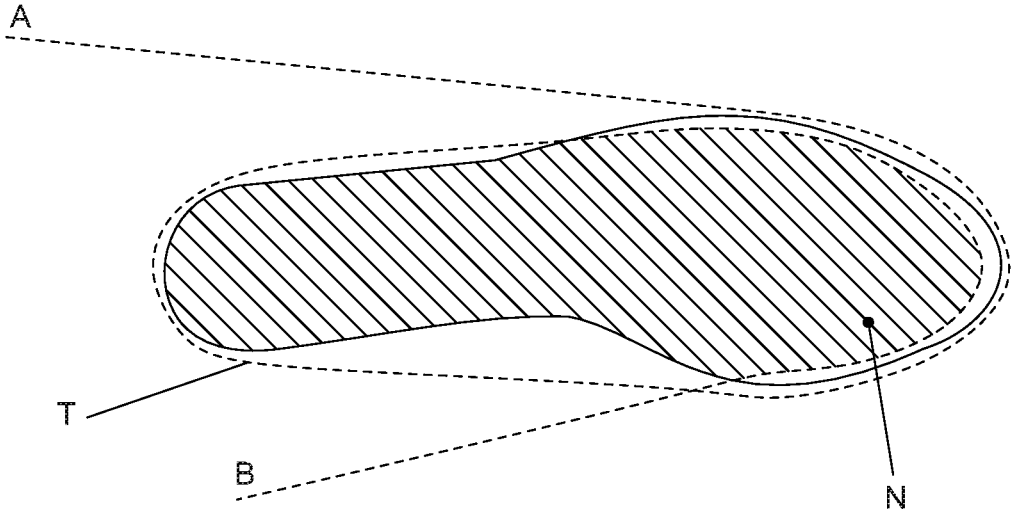
FIG. 6: Shows the assembly by string traction, with the application of stitching only to the external contour of the upper, resulting in unwanted distance and space between the upper and the mold.
Figure 7:
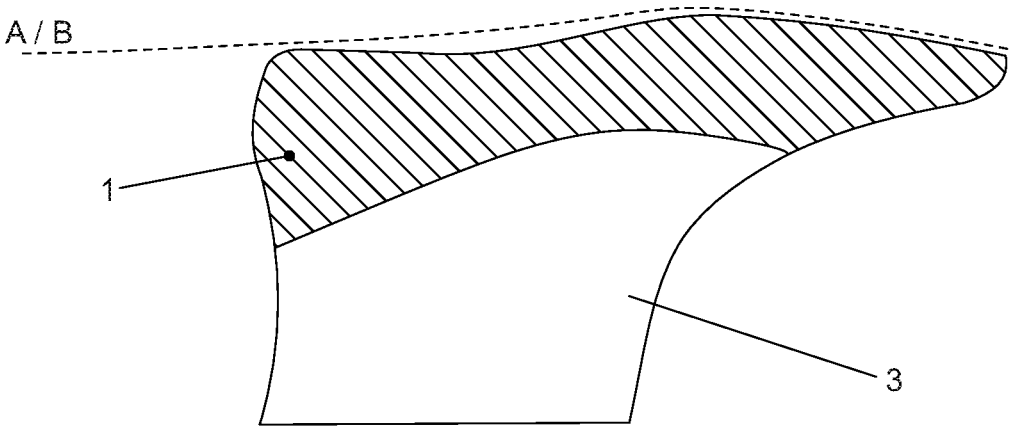
FIG. 7: Shows FIG. 6 in side view.
Figure 8:
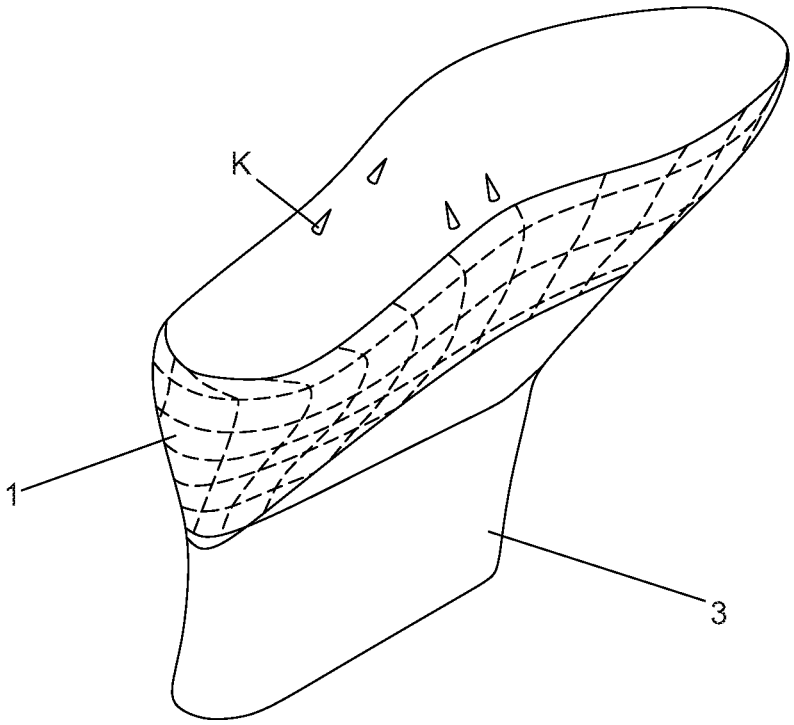
FIG. 8: Shows in perspective the use of metal barbs fixed to the mold.

Thus, the modeler can decide, based on the combined choice of the position of the "X" and the angle of the string traction (2), which region of the upper needs to be assembled first, so that the fitting of the upper (1) to the mold (3) is complete, proportional, symmetric and simultaneous. As an example, one can cite the assembly of boots, since this model of shoe requires that the region of the instep of the foot, is the first region to be compressed against the mold, so that the fit is perfect and lateral wrinkles do not form during the assembly;

Overlock stitching sequence overlapping the traction string: After the demarcations, the stitching at the tip (C) begins, as shown in FIG. 1, observing the progressive sequence until (H) the operation is concluded;

Assembly of the upper on the mold and string traction: after the grouping of the upper (1) with the mold (3), the ends of the string are tractioned (2) in accordance with the vertical direction indicated in the references (A) and (B) as shown in FIG. 4 and references (A) and (B) according to FIG. 3; the result is the full closure of the edge of the upper on the mold, with or without insoles, in accordance with the vectorization (V) shown in FIG. 3.

Figure 9:
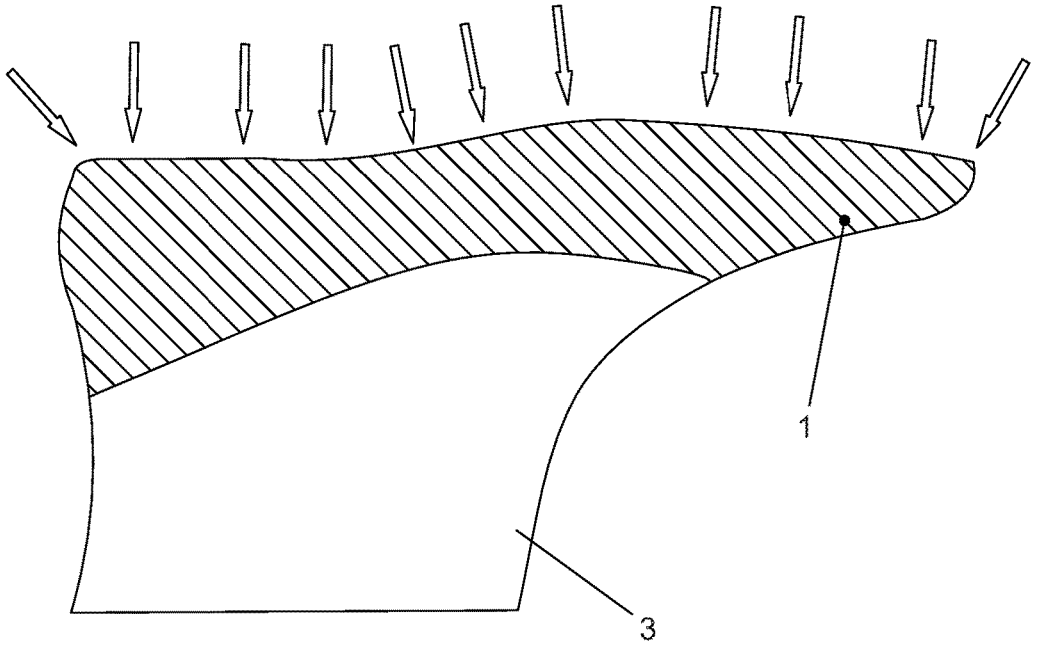
FIG. 9: Shows, in a side view, the X, Y and Z vectorization.
Figure 10:
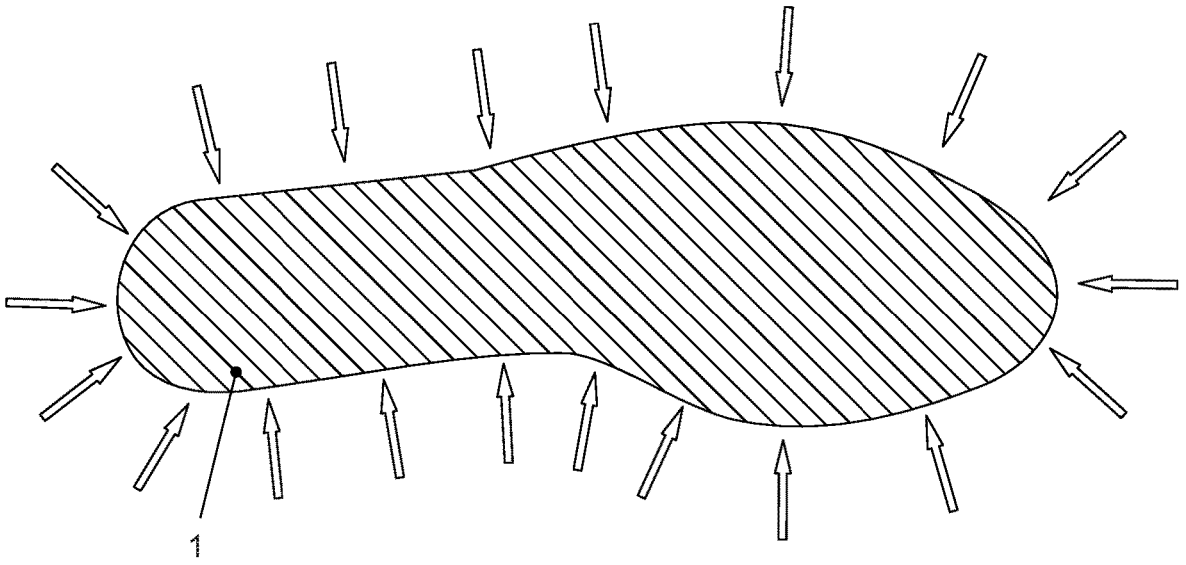
FIG. 10: Shows, in a top view, the X, Y and Z vectorization.

Other characteristics can be credited to the invention, namely:

Full assembly of the upper in a single operation: After the overlock stitching is applied to the upper (1), in accordance with the execution of the strategy at "X", at the points shown in FIG. 1, with the upper (1) pre-attached to the mold and duly heated, the string traction (2) progressively and simultaneously begins, which characterizes the assembly. The resulting traction vectorization on the upper to the mold occurs on three-dimensional planes X, Y and Z, as shown in FIG. 3; FIG. 9 and FIG. 10, in a single operation, this results in the full assembly of the shoe, homogeneously and with perfect sealing;

When the upper is mounted, it is exposed to a traction force; this force is distributed throughout its edge simultaneously, generating anatomical stabilization in accordance with the mold, without deformations, free of high voltage lines (great resistance), and sectorized, as occurs in other assembly methods, especially those that use gripping clamps (and traction), by the way the force used is distributed;

Coverage of assemblies in different materials that compose the uppers: the "X" stitching strategy allows for the assembly of shoes made with synthetic uppers, but also of leather, or mixtures of leather and synthetic materials, structured with armor and buttressing, previously an exclusive characteristic of partial assembly machines. This is possible because the "X" stitching strategy is associated with the equipment developed by the applicant, whose strength and traction control allow for the assembly of the upper, in any of these materials, in a single operation, in high productivity sequences. This association brings another unexpected advantage to the process, because it eliminates the need to end in a knot, previously necessary to prevent the assembly by "string" from unravelling, after the fitting of the upper. This confers speed on the operation and mobility on the operator;

Savings in raw material and reduction in waste: the development of the "string" stitching system based on the strategy of the "X", led to the consequent assembly of structured shoes of higher added value, consisting of liners, buttresses and armor. Compared to the partial assembly system, which works with the traction clamps, the uppers assembled by string, with the "X" strategy, are reduced, on average by 6 mm along the outer edge; the liner is also reduced by about 8 mm on the edge of the upper, and consequently, the armor (structural reinforcement of the toe) and the buttress (structural reinforcement of the rear) also have their outer edges proportionally reduced. In addition to this, there is no longer a need for lining, armor and buttresses of highly structured thick or rustic materials, for general-purpose shoes, because the traction force, which allows for the full assembly of the upper, does not form tension lines capable of breaking or compromising the upper. The aspect that contributes to the reduction of the residues resulting from the assembly of shoes by string traction, is the general reduction of the area of the upper and its components. This smaller edge will be folded under the upper, to receive the sole, glued or injected, thus concluding the assembly of the shoe. In the partial assembly methods, these edges need to be larger to be fastened by the gripping clamps; however, after being folded and glued to the assembly insole, the edges form a wrinkled crust that needs to be removed, usually by sanding, so that the sole can be properly incorporated into the shoe and the user does not feel discomfort on walking in it. All this extra material, turns into a residue.

Only in the assemblies of leather shoes, by string traction and cross stitching, is the use of sanders necessary and only to make the surface of the edge of the upper that received the adhesive rough and permeable, for the fixing of the sole. In the assemblies by string, with X stitching, it is not necessary to use fabric latches or nails, in the region of the shank, so there are further savings of raw material and a consequent reduction in waste. In the assembly by string, with X stitching, it is possible to assemble the shoe without the assembly insole and without the knot for fixing, which is to say, there is a reduction of the insole material and of labor for the knot of the string, which reductions extended to a large production scale, become highly significant;

High quality and a gain in comfort, even in assemblies of models with a high degree of difficulty, using the partial assembly method: Assembly of shoes with high heels, boots and with pointed toes, including with winkle-pickers, of delicate materials, with pre-decorated textures or uppers: The negative angles are challenges for partial assemblies. One of the reasons is the equipment used for this purpose, which is quite crude, executing the bending of the edges of the upper by brute force, causing tension lines, which cause the breakage of the molds, the ruptures of the uppers, the smoothing of textures, making it impossible to assemble an upper with ornaments. The partial assemblies have even more handcrafted characteristics, mainly due to the high dependence on the operators, because the equipment does not have a high degree of automation, thus, each model is positioned and each clamp executes the elongation according to the personal standards of the operator responsible for the assembly of the shoe. This causes a loss in quality, comfort, regularity and time. Although these machines possess resources and technology, they are still used as simple tools and not as machine tools. While the shoes assembled by "string" and with the "X" stitching strategy, have the traction force distributed along the assembly edge of the upper, which prevents the formation of tension lines. The position and the angle of the traction string, in an upper assembly with a X stitching, allows for the full assembly of the upper, with perfect fitting, as predetermined by the modeler at the time of the creation of the model, including the area of the shank, side, rear, toe and instep, without losing productivity, which helps to reduce costs and maintain quality. The gain in comfort is the result of a series of conditions produced by the string traction assembly technique, with X stitching. One of these aspects is the perfect fit of the upper to the mold, capable of copying to the shoe the lines and contours of the human foot, resulting in a shoe with a balanced fit, which respects the anatomy of the foot. Another aspect is the possibility of creating a shoe from more malleable and softer materials, or without an assembly insole, conferring greater flexibility on the shoe. Even the possibility of assembling a pair of shoes, where one foot is equal to the other (repeatability of results) and of respecting the initial predeterminations of the creation of the shoe creation, provided by the modeler, are points to be considered, for gains in comfort;

High productivity: Assembly by string traction, with a "X" stitching strategy, allows for the full assembly of the upper in only one operation. Currently, these assemblies take 8 seconds on average, and can go down to 4 seconds, in cases of the assembly of shoes with straight soles, called "flats". With this system we can fully assemble up to 2200 pairs of shoes with straight soles, in 8 hours of work, or an average of 1800 pairs of shoes of general models. On average, the partial assembly method, assembles 1600 pairs of shoes parts (only the toe, or the toe and the shank, or only the rear, or the rear and the shank), in 8 (eight) hours of work.

Figure 11:
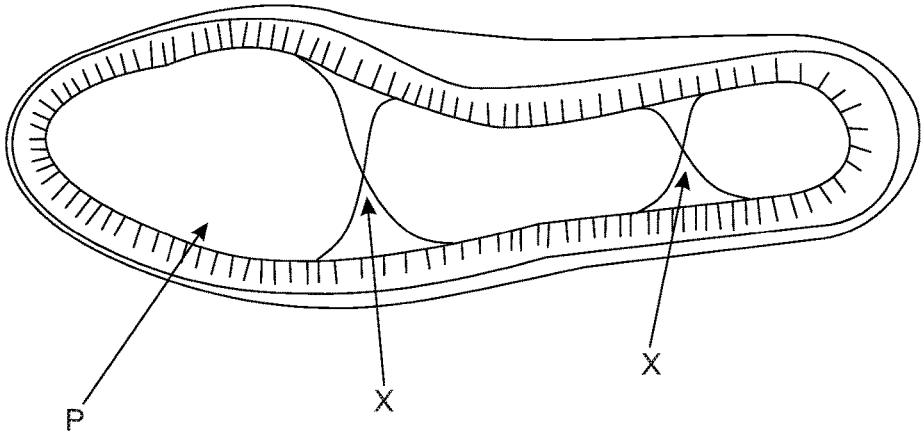
FIG. 11: Shows a version of the upper and insole with a double "X", with proportional fitting of the upper, at negative angles of the mold, without the need for metal or fabric latches.

FIG. 11 shows a version of an upper (1) and insole (P) with a double "X" (X), with proportional fitting of the upper (1), at negative angles of the mold (3), without the need for metal or fabric latches.

Figure 12:
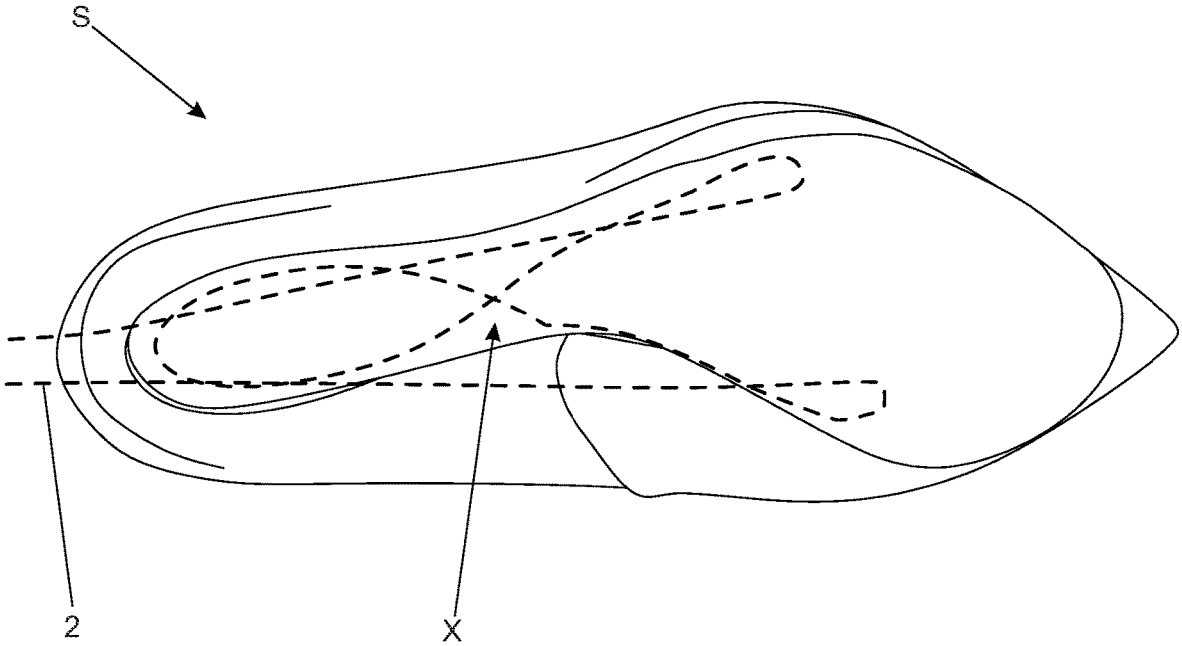
FIG. 12: Shows a model of a pump, with an increased upper in the area of the shank, to allow fitting without a fabric or metal latch.

FIG. 12 shows a model of pumps (S), with an enlarged upper (1) in the area of the shank (C), to enable fitting without a metal or fabric latch.

Figure 13:
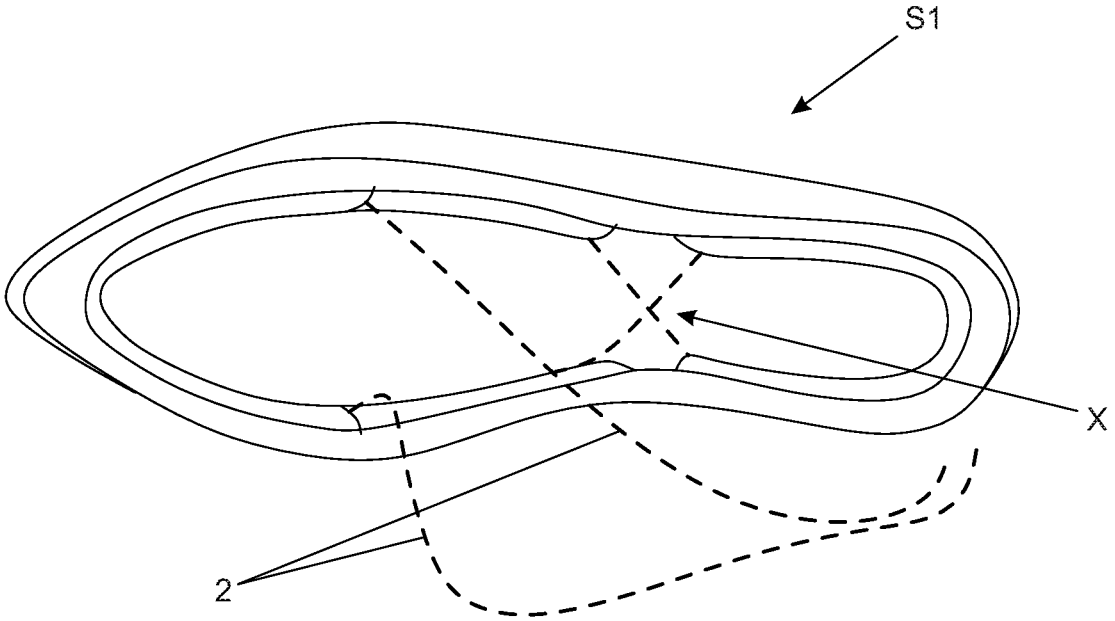
FIG. 13: Shows a semi-bagged sneaker, i.e., with a fabric latch.

FIG. 13 shows a semi-bagged sneaker (Si), which is to say, with a fabric latch.

Figure 14:
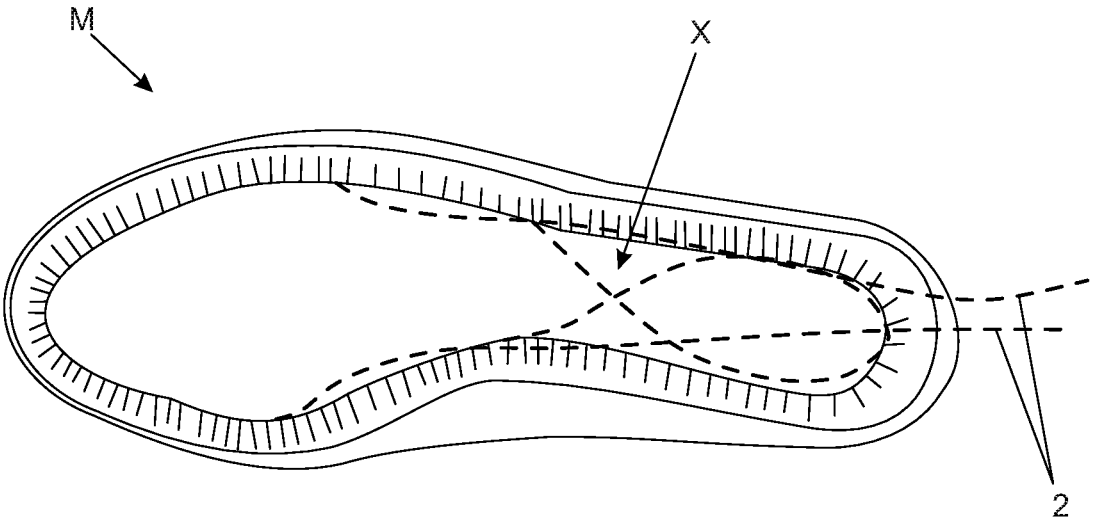
FIG. 14: Shows a string tractioning process in a moccasin with "X" stitching, in a tractioning machine according to the patent application of the same applicant—BR 10 2015 013357 0.

FIG. 14 shows the process of string traction (2), in a moccasin (M) with "X" (X) stitching, with said tractioning carried out on a tractioning machine (M1) in accordance with the patent application of the same applicant, where one observes the mold (3) and string traction module (M2), which performs the tractioning operation, once the "X" is realized.

Figure 15:
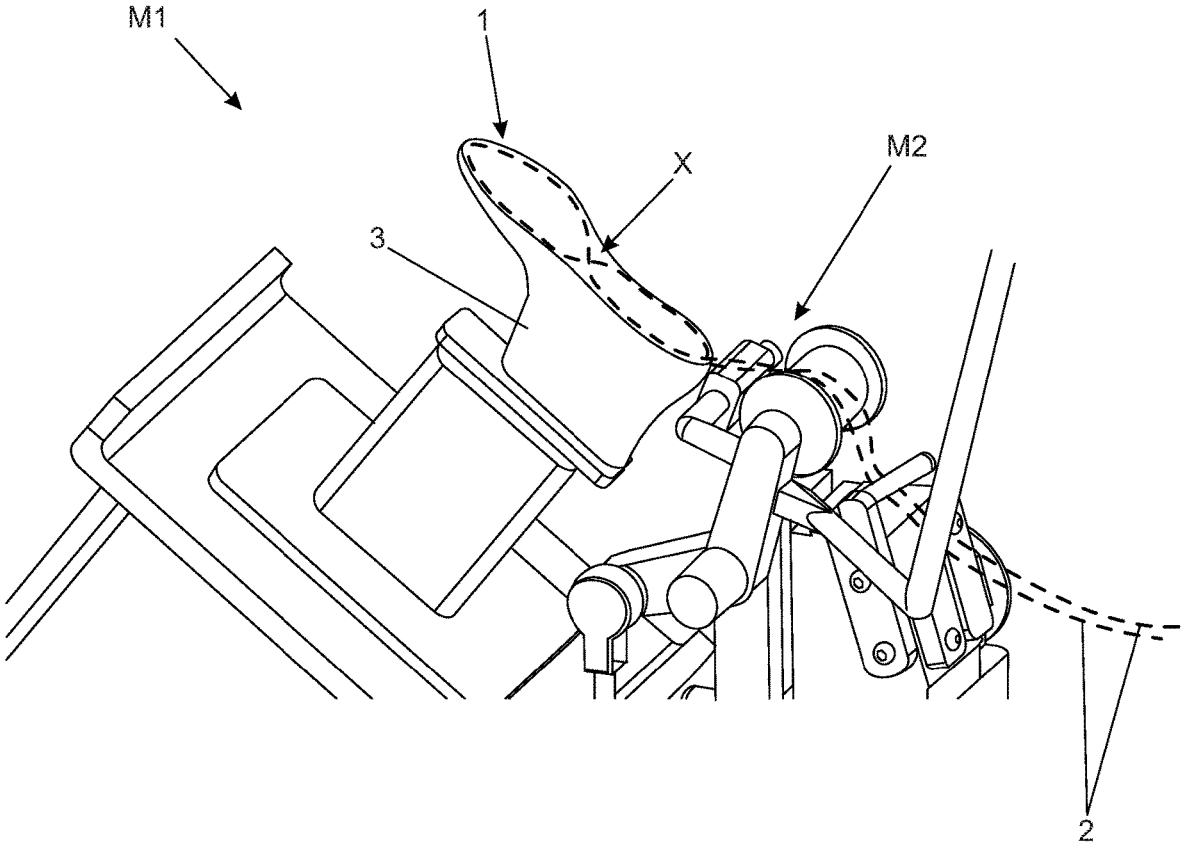
FIG. 15: Shows a string tractioning process in a boot with "X" stitching, in a string tractioning machine in accordance with the patent application of the same applicant—BR 10 2015 013357 0.

FIG. 15 shows the process of the tractioning of the strings (2) in a boot (B1) with "X" stitching, with said tractioning being realized on a tractioning machine (M1) in accordance with the patent application of the same application, where one observes the mold (3) and the string traction module (M2), which performs the string tractioning operation, once the "X" is realized.

What is claimed is:

1. An X stitching method for mounting uppers using a string lasting system, which includes an application to an upper (1), for full assembly of shoes, using traction string (2) as an element for closing edges of the upper (1), against a mold (3) that has a body and a sole, the method comprising:

generating a cross vector tractioning force by sewing, resulting in full, proportional, symmetric and simultaneous fitting, of the upper (1), to the body and the sole of the mold (3), in a region of an insole, completely covering a toe area, an area in a region of a shank and a rear area stitching at least one "X" (X), to an upper (1), for full assembly of shoes, using the traction string (2) for closing the edges of the upper (1), against the mold (3), where a position in which the upper (1) is found in the mold, at the time of the stitching front or back, does not modify the result of stitching;

determining a start point (C) and an end point (H) of the stitching;

assuring that the traction string (2) has sufficient length to facilitate their fixing ends of the traction string (2) to a tractioner;

determining an X position through which the traction string (2) must pass, from one side to another and vice versa; this X position determines an inversion of a stitching side of the upper (1), in the "shank" (C);

tractioning the upper (1) in a vector direction (V), resulting in a full fitting of the upper (1), against the mold (3);

stitching from the start point (C), until end point (H); and assembling the upper on the mold by tractioning the ends of the traction string (2) after grouping the upper (1) with the mold (3) in accordance with the vector direction (V) resulting in the full closure of the edge of the upper on the mold.

2. The method according to claim 1, wherein stitching the "X" (X) enables assembly of all models of shoes and all known heights of heels; further comprising gluing or injecting the sole to upper.

3. The method according to claim 1, wherein the upper closes on the mold (3) in three-dimensional planes X, Y and Z, in a single operation; resulting in full assembly of a shoe, homogeneously and with sealing.

4. The method according to claim 3, wherein the "X" (X) stitching is performed on a string traction machine (M1), and the tractioning step is performed with a string tractioner module, after the "X" stitching is performed.

* * * * *